US006078287A

United States Patent [19]

Thompson et al.

[11] Patent Number: 6,078,287

[45] Date of Patent: Jun. 20, 2000

[54] BEAM FORMING NETWORK INCORPORATING PHASE COMPENSATION

[75] Inventors: James D. Thompson, Manhattan Beach; Steven O. Lane, Rolling Hills Estates, both of Calif.

[73] Assignee: Hughes Electronics Corporation, El Segundo, Calif.

[21] Appl. No.: 09/373,667

[22] Filed: Aug. 13, 1999

[51] Int. Cl.[7] ..... H01Q 3/22; H01Q 3/24

[52] U.S. Cl. ..... 342/368; 342/372; 342/373

[58] Field of Search ..... 342/81, 154, 368, 342/372, 373

[56] References Cited

U.S. PATENT DOCUMENTS 4,231,040 10/1980 Walker .
4,424,500 1/1984 Viola .
4,543,579 9/1985 Teshirogi .
5,151,706 9/1992 Roederer .
5,539,415 7/1996 Metzen .
5,760,741 6/1998 Huynh .

*Primary Examiner*—Thomas H. Tarcza
*Assistant Examiner*—Dao L. Phan
*Attorney, Agent, or Firm*—Terje Gudmestad; M. W. Sales

[57] ABSTRACT

A beam-forming network having a network of phase shifting devices that is independent from other parts of the beam-forming network. In one embodiment, the network of phase shifting devices has multiple layers between the power divider and power combiner layers. The multiple layers provide a selectable phase shift for each feed independent from the other feeds. In another embodiment, the network of phase shifting devices is one layer of commendable phase shifters. In any embodiment, the resulting composite beam has higher directivity and lower side lobes as compared to conventional beam-forming networks.

24 Claims, 5 Drawing Sheets

BEAM FORMING NETWORK INCORPORATING PHASE COMPENSATION

TECHNICAL FIELD

The present invention relates to a multiple beam antenna array. More particularly, th e present invention relates to a system for real zing a phase distribution among several feeds in a multiple beam antenna array.

BACKGROUND ART

Multiple beam antennas form a plurality of communication beams. Communications satellites typically employ multiple beam antennas that have one or more feed elements feeding a reflector or a lens.

Multiple beam antennas usually have feed element groups that overlap, whereby a feed element is driven to generate a component beam that is combined with component beams from other feed elements to form a composite beam, or communications beam. A low-level beam forming network within the communications satellite controls the interaction of feed elements.

Conventional beam forming networks that generate multiple beams from a feed array describe planar dividers and combiners connected by individual connections having equal propagation delays. However, equal propagation delays are not always desirable. In some applications it is desirable to choose different propagation delays or phase shifts in order to improve the performance of the composite beam formed from the component beams.

For example, when the focal length of a reflector or lens antenna is relatively short compared to the aperture diameter, there may be phase and amplitude errors in the resulting aperture distribution for beams not near the antenna boresight. In such cases, it is desirable for the amplitude and phase of the beam-forming network to be adjusted to compensate for these errors.

Another example where adjustable beams are desired is in the case of an array built on a planar surface, as opposed to a spherical surface. An array on a planar surface significantly reduces the manufacturing and assembly costs. However, it introduces the need for selectable amplitude and phase weights for each beam to optimize the antenna's performance. Individually weighting the contribution from each beam compensates for the aberration caused by building the feeds on a planar surface.

SUMMARY OF THE INVENTION

The present invention describes a beam-forming network having a network of phase shifting devices that is independent from other parts of the beam-forming network. In one embodiment, the network of phase shifting devices has multiple layers between the power divider and power combiner layers. The multiple layers provide a selectable phase shift for each feed of each beam independent from the other beams. In another embodiment, the network of phase shifting devices is one layer of commandable phase shifters. In either embodiment, the resulting composite beam has higher directivity and lower side lobes as compared to conventional beam-forming networks.

The multi-layer phase distribution network of the beam-forming network of the present invention has two phase shifting layers between the power divider layer and power combiner layer. The two phase shifting layers incorporate digital or analog control to provide the required phase shift for realizing the desired phase distribution. Independent control of the amplitude distribution for each beam may be accomplished by adjusting couplers or using different couplers in the power divider and power combiner layers.

The power dividers and combiners can be identical for each beam even though the phase and amplitude distribution is not necessarily identical. Significant cost savings is realized in both the design and manufacture of the beam-forming network of the present invention.

It is an object of the present invention to create the advantage of realizing phase distribution among several feeds in a multiple-beam antenna in order to introduce flexibility in the beam-forming network. It is another object of the present invention to add multiple layers to the phase shift network. The layers utilize short pieces of transmission line in order to provide independent phase shifts and improve the performance of the beam-forming network. It is yet another object of the present invention to utilize common power dividers and combiners for each beam, even though the phase distribution is not necessarily the same for each beam in order to reduce costs associated with beam-forming networks.

Other objects and features of the present invention will become apparent when viewed in light of the detailed description of the preferred embodiment when taken in conjunction with the attached drawings and appended claims.

BEST MODES FOR CARRYING OUT THE INVENTION

Figure 1A:
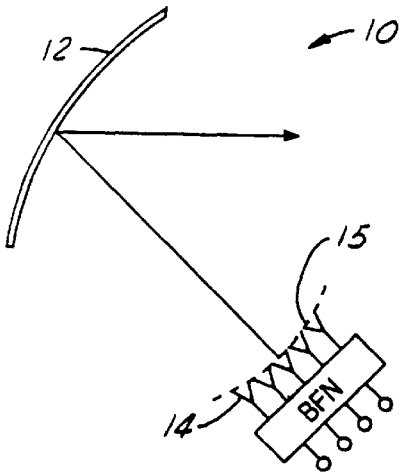
FIG. 1A is an illustration of a typical multiple beam offset reflector antenna.

FIG. 1A shows a typical multiple-beam antenna 10 having an offset reflector 12 illuminated by an array of feeds 14. The feeds 14 are usually horns, cup dipoles, patch antennas, or other similar radiating elements. In the example shown in FIG. 1A, the feeds 14 are located on a spherical surface 15. A spherical surface is used to enhance the performance of the beams that point in directions that are not on the boresight axis of the reflector system.

Figure 1B:
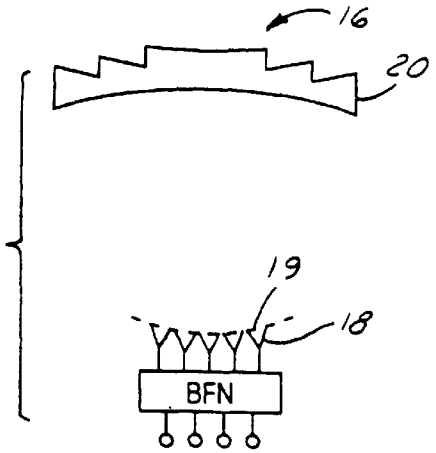
FIG. 1B is an illustration of a typical multiple beam lens antenna.

FIG. 1B is another example of a multiple-beam antenna 16, also illuminated by feeds 18 on a spherical surface 19. A lens 20 is used instead of a reflector. In either antenna, an offset reflector 12 or a lens 20, the feeds can be placed on a planar surface (shown in FIG. 3). A planar surface eases the manufacture and assembly of the beam-forming network. However, the beam-forming network must be phase compensated for the movement from the optimal spherical feed focus. This will be discussed in greater detail hereinafter.

Other antenna configurations are possible, although not specifically described or shown herein. For example, it is possible to have a multiple beam antenna system having a side-fed offset cassegrain antenna or a front-fed offset cassegrain antenna.

Figure 2:
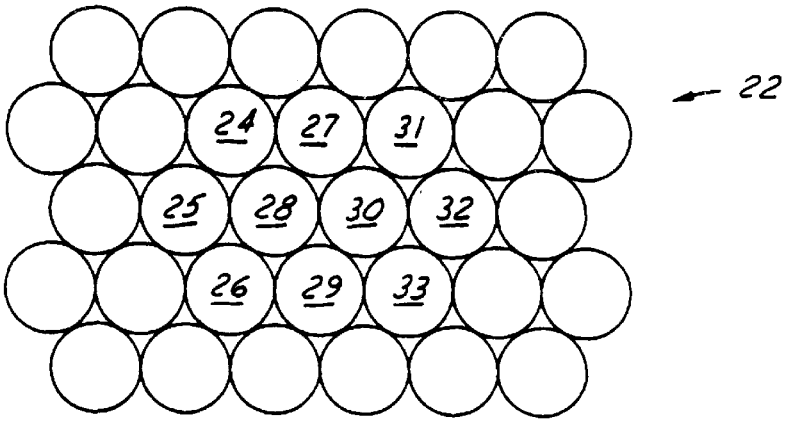
FIG. 2 is an illustration of a typical feed array layout.

FIG. 2 is an example of a typical layout for a feed array 22. A communications beam is formed by combining signals from several feeds in a beam-forming network. In the example shown in FIG. 2, there are seven (7) feeds per beam. Some feeds may be used for more than one beam. For example, in FIG. 2, a first beam is formed from feeds labeled 24 through 30. A second beam is formed from feeds 31 through 33 and feeds 27 through 30. Feeds 27, 28, 29 and 30 are shared for both the first and second beams.

While FIG. 2 shows an example of an equilateral triangular lattice having seven feeds per beam, it is possible to arrange the lattice in other shapes such as squares or even in non-equilateral triangles. It is also possible to use fewer or more than seven feeds per beam.

The following detailed description is written in terms of a receiving antenna. However, following reciprocity principles, the present invention is equally applicable to a transmitting antenna.

Figure 3:
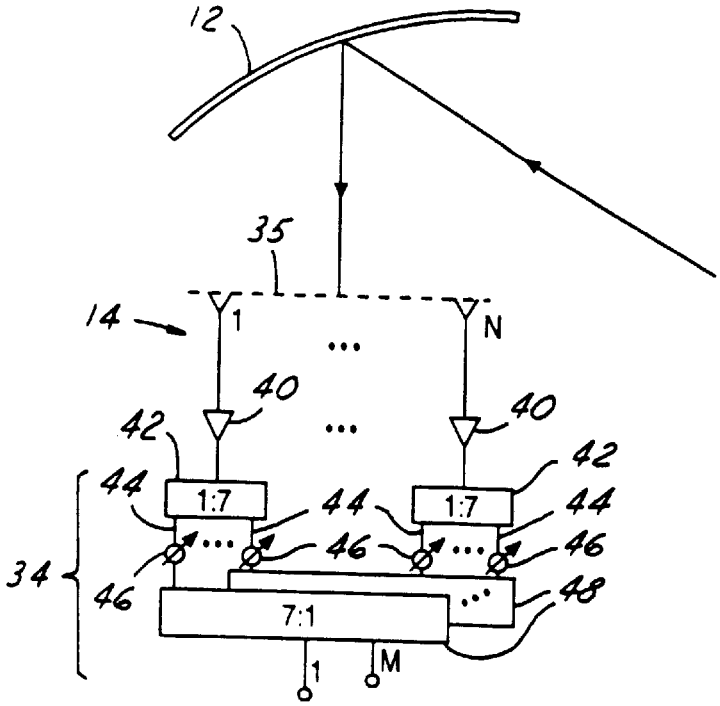
FIG. 3 is an illustration of a reflector antenna having a feed array on a planar surface.
Figure 4:
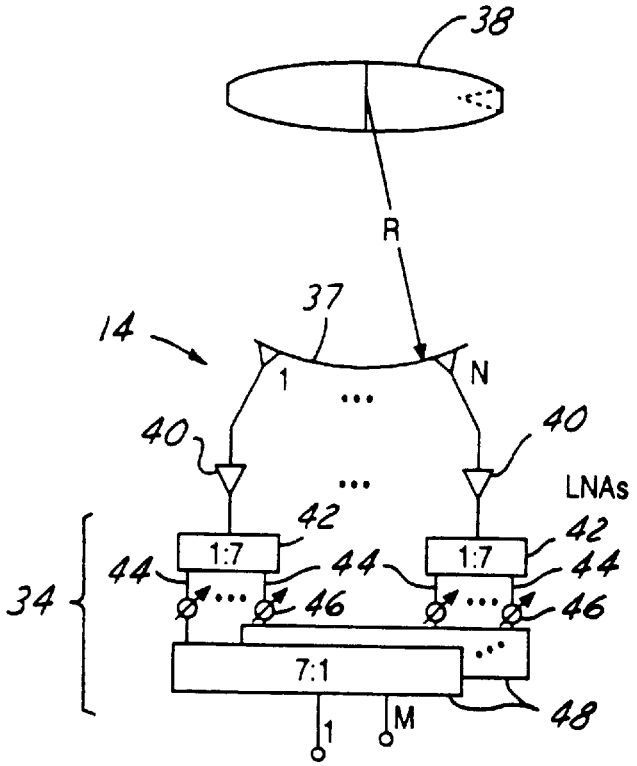
FIG. 4 is an illustration of a multiple beam lens antenna having a feed array on a spherical surface.

FIG. 3 is a block diagram of the beam-forming network 34 of the present invention as applied to a reflector antenna 12 in which the feed array 14 is on a planar surface 35. As discussed earlier, the planar surface 35 makes the array easier to construct. FIG. 4 is a block diagram of the beam-forming network 34 of the present invention as applied to a lens antenna 38. The feed array 14 is shown on a spherical surface 37 which generally results in the best antenna performance for beams that are scanned away from the antenna boresight.

In FIGS. 3 and 4, like elements have like reference numerals. The number of feeds in the feed array 14 is any integer number 1 through N. While the following description will limit the number of feeds used per beam to seven, any number of feeds could be used. There is shown in FIGS. 3 and 4 a set of low noise amplifiers 40 followed by a set of power dividers 42, each set having a number of respective components that is equal in number to the number of feeds in the feed array.

A network of phase shifting interconnects, shown as transmission lines 44 and phase shifters 46, is located between the network of power dividers 42 and a network of power combiners 48. The number of power combiners 48 are represented by any integer number 1 through M, where M represents the number of beams to be formed.

The phase shifting interconnects may be implemented using phase shifters, time delayers, or a combination of phase shifters and time delayers. Phase shifters are commonly defined to have the same phase shift over a band of frequencies, while time delayers have phase shift that varies with frequency. A common technique is to use a length of transmission line as a time delayer. The phase shift is related to transmission line length by the following equation:

$$\phi = \frac{-360}{\lambda} L$$

where $\phi$ is the phase shift in degrees, $\lambda$ is the wavelength of operation, and L is the length of transmission line having the same units as the wavelength of operation. The decision to use phase shifters, time delayers, or a combination of both will depend on the required bandwidth of operation.

As discussed earlier, the invention is described herein with reference to seven-way power dividers and combiners. In operation, a beam is formed by dividing a signal from a feed, (horn or otherwise), in the feed array 14 into seven parts using a seven-way power divider 42. The power divider division ratio determines the amplitude weighting for the feed signal. Each of the power divider outputs, seven per divider in the present example, is phase shifted. A length of transmission line, or any other phase shifting means, introduces the necessary phase shift for each divided feed signal.

The power combiners 48, seven-way combiners in the present example, sum the phase-shifted feed signals. In the present example, there is one feed signal from the center feed and six feed signals from the adjacent feeds. All seven amplitude adjusted and phase shifted signals are combined to form a communications beam.

In the beam forming network of the present invention, the power divider power division ratio, and the phase shift associated with each output at the power dividers can achieve any desired set of weighting functions, (hereinafter referred to as weights), for the feed signals. In simplified cases, the amplitude distribution of the weights is the same for all beams, the phase distribution of the weights is the same for all beams, or both the amplitude and phase distributions are the same for all beams.

The present invention is capable of generating an optimum weight for each beam individually. The present invention allows the amplitude and phase of the beam-former to be adjusted to reduce phase errors. The present invention eliminates errors that occur as a result of aperture distribution for beams further than a predetermined angular distance from the antenna boresight, such as in the case of an antenna having a focal length that is relatively short in comparison to the aperture diameter.

The individuality of beam weights that is associated with the present invention also allows a feed array to be built on a planar surface without having to compensate the phase for the movement from the optimal spherical feed locus. A different set of amplitude and phase weights can be selected for each beam, thereby optimizing the antenna's performance. The weighting differences can compensate for the aberration caused by having the feeds on a planar surface.

Figure 5:
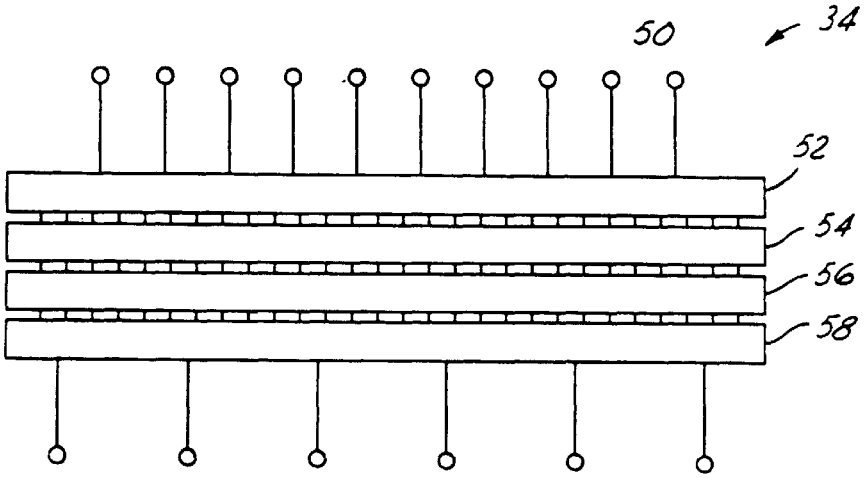
FIG. 5 is a cross-section of the beam-forming network of the present invention.

FIG. 5 is a block diagram of one embodiment of the beam-forming network 34 of the present invention. The beam-former 34 is built in four layers. Feed inputs 50 are fed into the first layer 52 which is the network of power dividers. There is one power divider for each feed in the array.

The second layer 54 is a network of transmission lines of various lengths, as is the third layer 56. The combination of the second and third layers 54 and 56 makes a transmission line of suitable length to provide the phase shift necessary to optimize the composite beam.

A fourth layer 58 contains a network of power combiners. Each power combiner sums the power from the feed signal at the center feed directly above the respective power combiner, plus six inputs from the feeds adjacent to the respective power combiner to form a beam.

FIGS. 6 through 9 are top views of each of the four layers showing possible paths for routing the transmission lines between components. In the present example, the transmission line media is shown as stripline. However, it should be noted that any transmission line media may be substituted without departing from the scope of the present invention.

Figure 6:
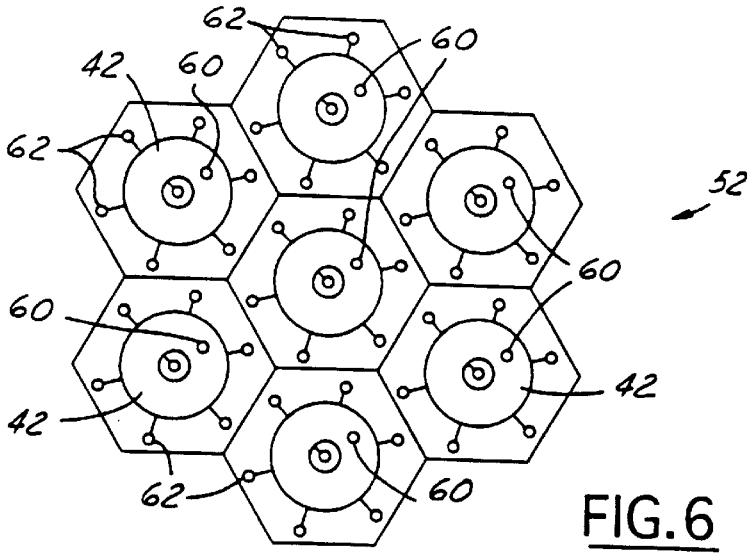
FIG. 6 is a top view of the divider layer for a layout with seven feeds per beam.

FIG. 6 is a top view of the power divider layer 52 for seven of the feeds in the feed array. The seven-way power dividers 42 have an input 60 that comes from each feed in the array. The power divider outputs 62, seven in the present example, are coupled to the first phase shift layer, shown in FIG. 7.

Figure 7:
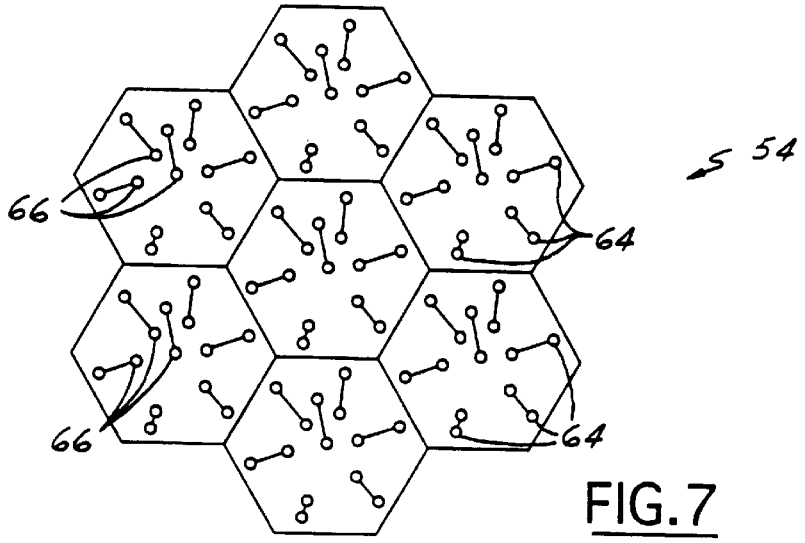
FIG. 7 is a top view of the first phase shift layer for a layout with seven feeds per beam.
Figure 8:
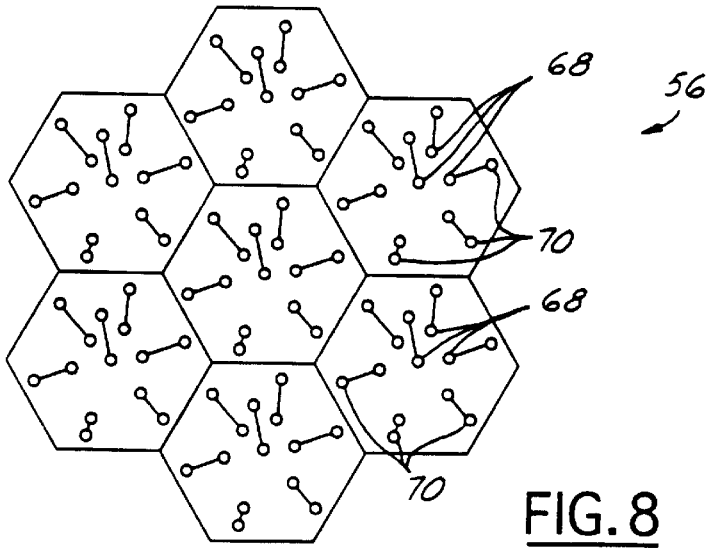
FIG. 8 is a top view of the second phase shift layer for a layout with seven feeds per beam.

The first phase shift layer 54 in FIG. 7 accepts seven inputs 64 for each feed from the power divider layer and sends seven outputs 66 for each feed to the second phase shift layer 56, shown in FIG. 8. The second phase shift layer 56 accepts the signals from the first phase shift layer at seven inputs 68 for each feed and sends seven outputs 70 for each feed to the power combiner layer.

Figure 9:
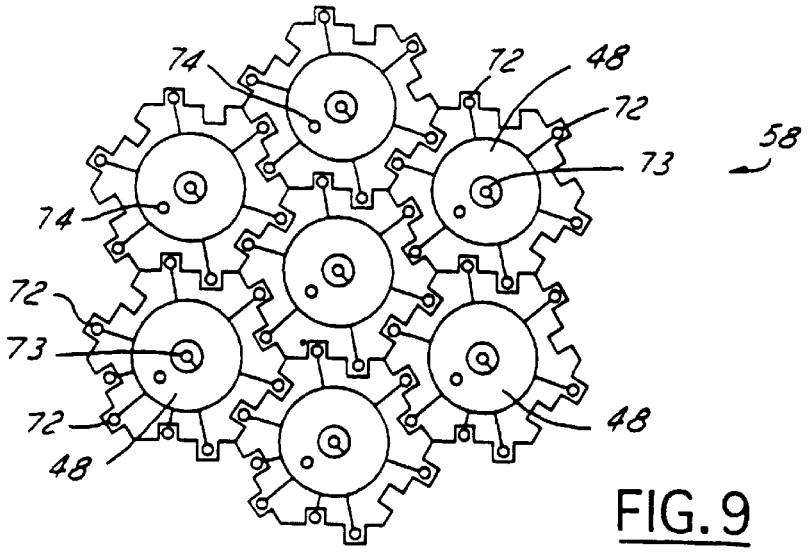
FIG. 9 is a top view of the combiner layer for a layout with seven feeds per beam

The power combiner layer 58 is shown in FIG. 9. Power combiners 48 accept inputs 72 from each feed, seven in all in the present example. One of the inputs 73 is from feed that is centrally located above a respective power combiner, and the six remaining inputs 72 come from surrounding feeds. Each of the power combiners 48 provide an individual output 74.

Figure 10:
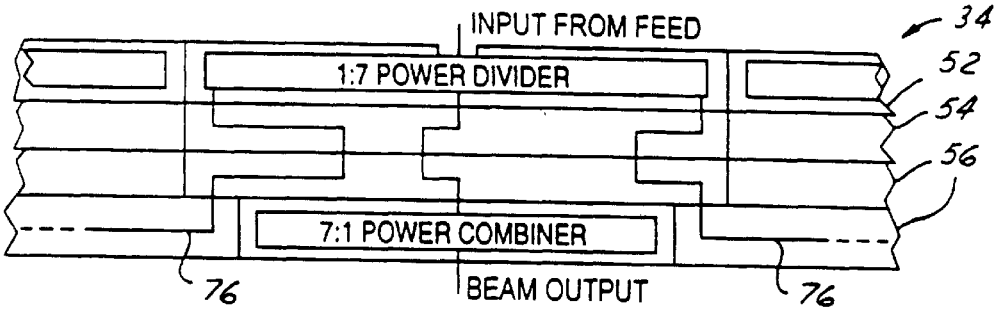
FIG. 10 is a cross sectional view of the beam forming network of the present invention illustrating the power dividing and phase shift functions.
Figure 11:
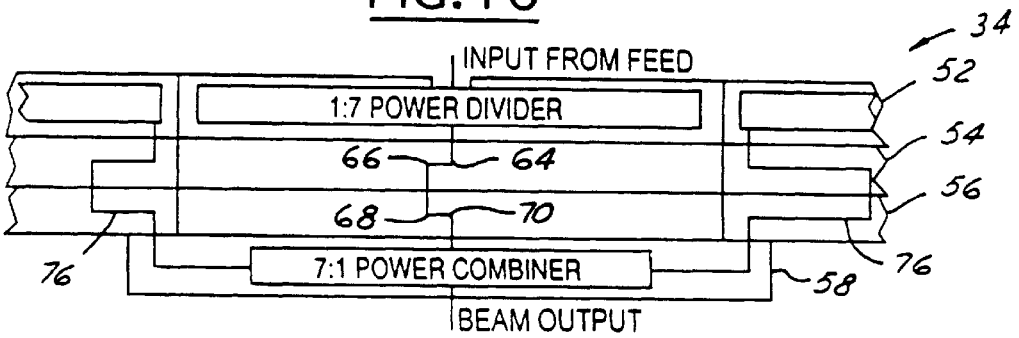
FIG. 11 is a cross sectional view of the beam-forming network of the present invention illustrating the power combining function.

FIG. 10 is a sectional view taken from FIG. 5 showing the inter-relation between the layers of the beam forming network as the input from the feed is divided and phase shifted by the transmission lines 76. FIG. 11 is a sectional view of the beam-forming network showing the power combining function. FIGS. 10 and 11 represent examples of how the transmission lines 76 may be routed in the beam forming network to accomplish the desired phase shift function.

The desired phase shift is defined by the transmission line length along the paths between the inputs and outputs among the layers of the beam forming network. For example, with reference to FIG. 11, the desired phase shift is determined by the length of transmission line that connects input 64 to output 66 in the first phase shift layer 54, the length of transmission line inter-connecting the two phase shift layers 54 and 56, and the length of transmission line connecting input 68 to output 70 in the second phase shift layer 56. The difference in the path lengths determines the correct phase.

Figure 12:
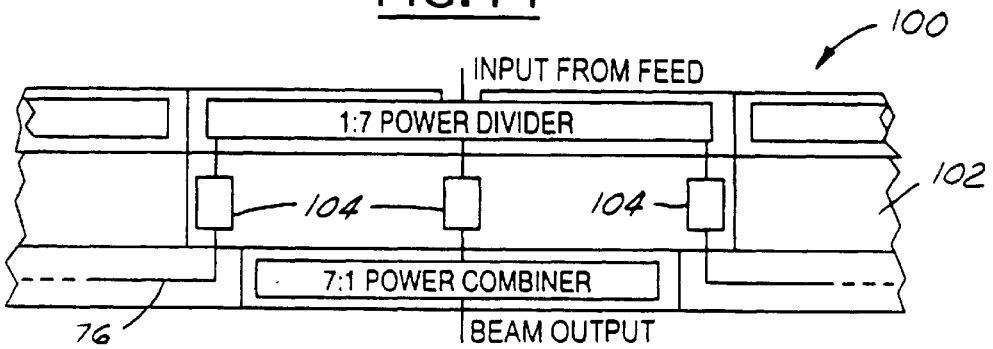
FIG. 12 is a cross sectional view of an alternate embodiment of the beam-forming network of the present invention incorporating commandable phase shifters.

FIG. 12 is another embodiment of the beam forming network 100 of the present invention. Instead of two separate phase shift layers, the beam forming network 100 contains a single phase shift layer 102 having commandable phase shifters 104. This embodiment of the present invention makes it possible to reconfigure the beam forming network 100 while it is in operation, adding even more flexibility.

Figure 13:
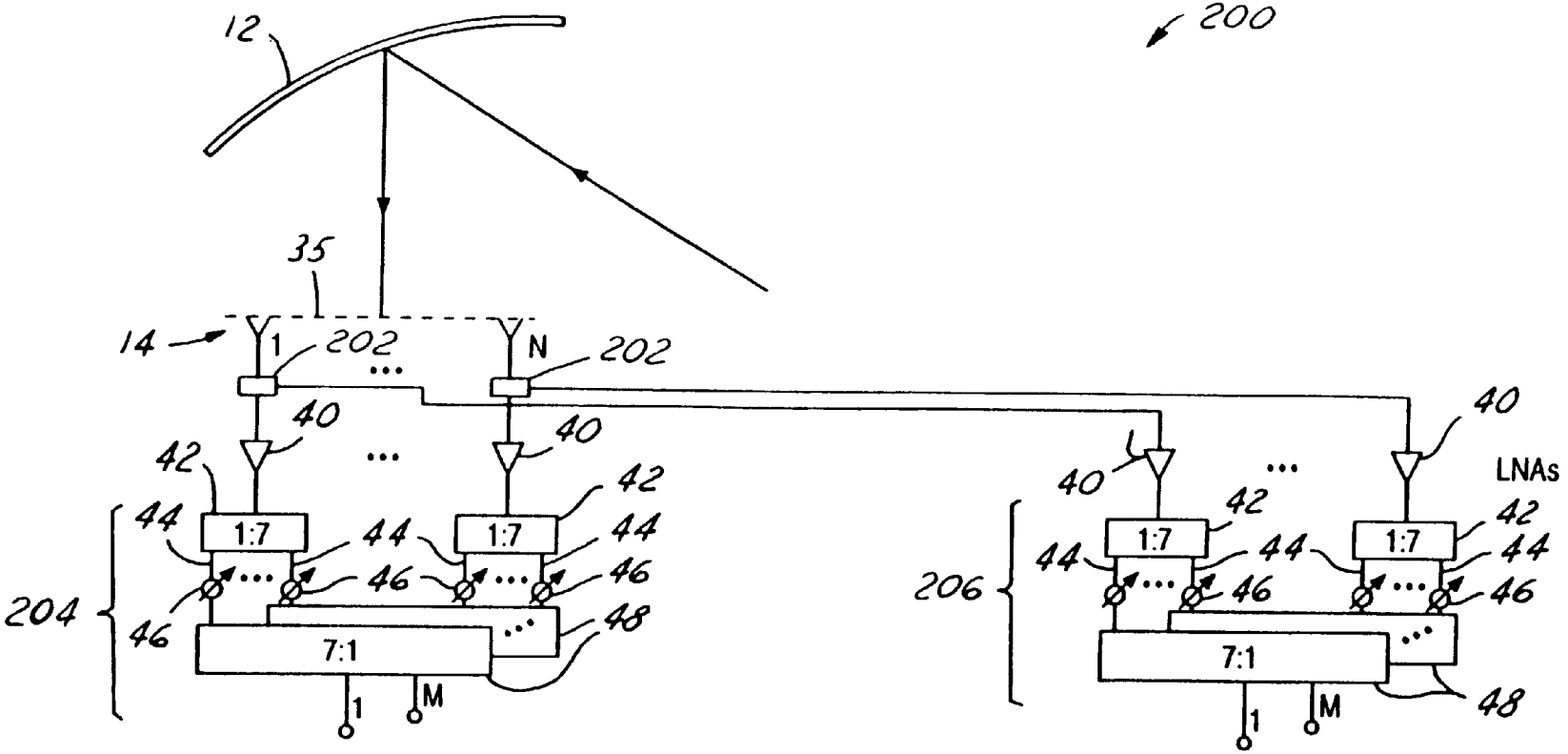
FIG. 13 is an illustration of a multiple beam antenna having dual polarizations.

The present invention has been described herein with reference to a single polarization. It is also possible to implement a dual polarized antenna. FIG. 13 is an illustration of a multiple beam antenna system 200 having dual polarization. It is possible to have devices 202, such as orthomode transducers, located at the feeds 14 to separate signals by their polarization. One polarization will be directed to the beam forming network 204, and the opposite polarization is directed to the beam forming network 206. The polarizations can be horizontal and vertical linear, or right hand and left hand circular. All other aspects of the beam forming network are the same as described above and like components have reference numerals similar to those explained in FIG. 3.

By separating the phase shifting function of the beam-forming network from the power divider and power combiner layers, the layers can be designed independently of each other. The layer, or layers, containing the phase shifting function have transmission line lengths that may be different for each line, depending on the desired phase weighting for each beam.

While particular embodiments of the invention have been shown and described, numerous variations and alternate embodiments will occur to those skilled in the art. Accordingly, it is intended that the invention be limited only in terms of the appended claims.

What is claimed is:

1. A beam forming network for an antenna having an array of feeds, said beam forming network comprising:

a network of power dividers wherein each power divider in said network has an input coupled to a feed in said array of feeds, each power divider in said network has a power division ratio defining a plurality of outputs;

a network of phase shifters having a plurality of inputs wherein each input is coupled to an output of said network of power dividers, said network of phase shifters producing a plurality of phase shifted outputs, and wherein each input is phase shifted independently of the other inputs in said network of phase shifters thereby defining individual phase shifted outputs; and a network of power combiners having a plurality of inputs, wherein each input of said network of power combiners is coupled to an individual phase shifted output of said network of phase shifters, each power combiner in said network of power combiners having a single output derived from a combination of said plurality of inputs from said network of power combiners, said combiners operating in conjunction with said network of power dividers to determine an amplitude weight for a signal from each feed in said array of feeds and thereby define a beam.

2. The network as claimed in claim 1 wherein said network of phase shifters further comprises first and second phase shifting layers interconnected to each other and to said network of power dividers and said network of power combiners by transmission lines.

3. The network as claimed in claim 2 wherein said first and second phase shifting layers further comprise phase shifters for producing said individually phase-shifted outputs.

4. The network as claimed in claim 2 wherein said first and second phase shifting layers further comprise lengths of transmission line for producing said individually phase-shifted outputs.

5. The network as claimed in claim 1 wherein said network of phase shifters further comprises a single layer of commandable phase shifters coupled between said network of power dividers and said network of power combiners, whereby said individually phase shifted outputs can be altered while said beam forming network is in operation.

6. The network as claimed in claim 1 wherein the feed array is located on a planar surface.

7. The network as claimed in claim 1 wherein the feed array is located on a spherical surface.

8. The network as claimed in claim 1 wherein the feed array is located on a surface having a geometry that is designed for optimum beam scan performance.

9. A communications system comprising:

a multiple beam antenna system having an array of feeds; and a beam forming network coupled to said array of feeds, said beam forming network comprising:

a network of power dividers wherein each power divider in said network has an input coupled to a feed in said array of feeds, each power divider has a power division ratio defining a plurality of outputs;

a network of phase shifters having a plurality of inputs wherein each input is coupled to an output of said network of power dividers, said network of phase shifters producing a plurality of phase shifted outputs, and wherein each input is phase shifted independently of the other inputs in said network of phase shifters thereby defining a plurality of individually phase shifted outputs; and a network of power combiners having a plurality of inputs, wherein each input of said network of power combiners is coupled to an individual phase shifted output of said network of phase shifters, each power combiner in said network of power combiners each having a single output derived from a combination of inputs from said network of power combiners, said network of power combiners operating in conjunction with said network of power dividers to determine an amplitude weight for a signal from each feed of said array of feeds, thereby defining a beam.

10. The communications system as claimed in claim 9 wherein said network of phase shifters further comprises first and second phase shifting layers interconnected to each other and to said network of power dividers and said network of power combiners by transmission lines.

11. The communications system as claimed in claim 10 wherein said first and second phase shifting layers further comprise phase shifters for producing said individually phase-shifted outputs.

12. The communications system as claimed in claim 10 wherein said first and second phase shifting layers further comprise lengths of transmission line for producing said individually phase-shifted outputs.

13. The communications system as claimed in claim 9 wherein said network of phase shifters further comprises a single layer of commandable phase shifters coupled between said network of power dividers and said network of power combiners, whereby said individually phase shifted outputs can be altered while said beam forming network is in operation.

14. The communications system as claimed in claim 9 wherein the feed array is located on a planar surface.

15. The communications system as claimed in claim 9 wherein the feed array is located on a spherical surface.

16. The communications system as claimed in claim 9 wherein the feed array is located on a surface having a geometry that is designed for optimum beam scan performance.

17. A multiple beam antenna system comprising:

an array of feeds;

an orthomode transducer following said array of feeds for separating two orthogonal polarizations;

a first beam forming network for one of said two orthogonal polarizations, said beam forming network comprising:

a network of power dividers wherein each power divider in said network has an input coupled to a feed in said array of feeds, each power divider in said network has a power division ratio defining a plurality of outputs;

a network of phase shifters having a plurality of inputs wherein each input is coupled to an output of said network of power dividers, said network of phase shifters producing a plurality of phase shifted outputs, and wherein each input is phase shifted independently of the other inputs in said network of phase shifters thereby defining individual phase shifted outputs; and a network of power combiners having a plurality of inputs, wherein each input of said network of power combiners is coupled to an individual phase shifted output of said network of phase shifters, each power combiner in said network of power combiners having a single output derived from a combination of said plurality of inputs from said network of power combiners, said combiners operating in conjunction with said network of power dividers to determine an amplitude weight for a signal from each feed in said array of feeds and thereby define a beam; and a second beam forming network for the other of said two orthogonal polarizations, said second beam forming network comprising:

a network of power dividers wherein each power divider in said network has an input coupled to a feed in said array of feeds, each power divider in said network has a power division ratio defining a plurality of outputs;

a network of phase shifters having a plurality of inputs wherein each input is coupled to an output of said network of power dividers, said network of phase shifters producing a plurality of phase shifted outputs, and wherein each input is phase shifted independently of the other inputs in said network of phase shifters thereby defining individual phase shifted outputs; and a network of power combiners having a plurality of inputs, wherein each input of said network of power combiners is coupled to an individual phase shifted output of said network of phase shifters, each power combiner in said network of power combiners having a single output derived from a combination of said plurality of inputs from said network of power combiners, said combiners operating in conjunction with said network of power dividers to determine an amplitude weight for a signal from each feed in said array of feeds and thereby define a beam.

18. The system as claimed in claim 17 wherein each of said networks of phase shifters further comprises first and second phase shifting layers interconnected to each other and to said network of power dividers and said network of power combiners by transmission lines.

19. The system as claimed in claim 18 wherein each of said first and second phase shifting layers further comprise phase shifters for producing said individually phase-shifted outputs.

20. The system as claimed in claim 18 wherein each of said first and second phase shifting layers further comprise lengths of transmission line for producing said individually phase-shifted outputs.

21. The system as claimed in claim 17 wherein each of said network of phase shifters further comprises a single layer of commendable phase shifters coupled between said network of power dividers and said network of power combiners, whereby said individually phase shifted outputs can be altered while said beam forming network is in operation.

22. The system as claimed in claim 17 wherein said feed array is located on a planar surface.

23. The system as claimed in claim 17 wherein said feed array is located on a spherical surface.

24. The system as claimed in claim 17 wherein said feed array is located on a surface having a geometry that is designed for optimum beam scan performance.

* * * * *